US006048401A

United States Patent [19]

Hayashi et al.

[11] Patent Number: 6,048,401

[45] **Date of Patent: *Apr. 11, 2000**

[54] METHOD AND APPARATUS FOR IMMERSION-PROCESS

[75] Inventors: Hideaki Hayashi; Norio Kikukawa; Shinichi Kojima, all of Toyama, Japan

[73] Assignee: YKK Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,151

[22] Filed: Sep. 2, 1997

[30] Foreign Application Priority Data

Sep. 4, 1996 [JP] Japan ..... 8-253779

[51] Int. Cl.[7] ..... B05C 11/00

[52] U.S. Cl. ..... 118/702; 118/698

[58] Field of Search ..... 118/695, 702, 118/704, 698

[56] References Cited

U.S. PATENT DOCUMENTS 3,976,028 8/1976 Howells et al. ..... 118/702
5,601,650 2/1997 Goldbecker et al. ..... 118/702

FOREIGN PATENT DOCUMENTS

92/21953 12/1992 WIPO .

*Primary Examiner*—Brenda Adele Lamb
*Attorney, Agent, or Firm*—Hill & Simpson

[57] ABSTRACT

In a method and an apparatus for plating a plurality of kinds of works, an unattended route-free vehicle transports the works to a number of processing tanks to immerse the works in the processing tanks. A controller calculates a processing time of the processing tanks and a transporting time needed for the vehicle to transport the works to the processing tanks and renders the vehicle to transport one kind of the works during the immersion-processing of another kind of the works, thereby performing the plating process of a plurality of kinds of works one after another.

6 Claims, 3 Drawing Sheets

METHOD AND APPARATUS FOR IMMERSION-PROCESS

BACKGROUND OF THE INVENTION

1. Field of the Invention

This invention relates to an immersion-processing method and apparatus for plating or surface-treating metallic products.

2. Description of the Related Art

In the conventional production of slide fasteners, various plating, such as copper-plating, nickel-plating, zinc-plating or brass-plating, have been made on slide fastener parts of zinc alloy to meet various demands. In each conventional plating processes, as disclosed in, for example, Japanese Patent Laid-Open Publication No. Sho 55-14595, parts (hereinafter called the works) to be plated are suspended by hangers movable horizontally over and along a succession of fixed processing tanks and are immersed in the processing tanks by lowering and raising the hangers. The works suspended by the hangers are transported by a dedicated transporting unit which moves along a pair of rails fixed to the ceiling, and the driving of which is controlled by a computer. Further, data about processing conditions, such as a processing time of the works and a current value, are read and stored by the computer; based on the data, the hangers are moved by the transporting unit over the processing tanks to perform the plating of a plurality of works simultaneously.

Japanese Patent Laid-Open Publication No. Sho 63-30399 discloses a transportation system for transporting works to each of successive processing tanks. In the transportation system, the works are transported by a carriage movable on a pair of rails fixed to the floor so that the carriage is movable between two series of processing tanks parallel to the rails. A hanger-manipulator arm mounted on the vehicle for suspending the works can position hangers over each processing tank series and is horizontally turnable and vertically movable to immerse the works in the processing tanks.

This plating line is exemplified by a nickel-plating line, a brass-plating line and a zinc-plating line; each kind of works common in plating type are plated in an individual shared plating line. In this conventional plating line, a multiplicity of processing tanks filled with the same kind of plating liquid are arranged in an effort to improve the manufacturing efficiency in mass production, and for this purpose, a plurality of various pre-processing tanks (electrolytic degreasing tank, weak-acid neutralizing tank, etc.) used.

According to the foregoing prior art, since the processing tanks of each step and their associated devices are arranged in the factory as a dedicated line, it is useful when manufacturing the same kind of products by a large quantity, but when manufacturing various kinds of products by a small quantity, many steps and facilities would be wasteful in flexible manufacturing, thus lowering the availability. Further, in recent years, plating lines are required to perform various plating processes demanded by customers quickly, and it is necessary to manufacture many kinds of products efficiently without adding any facility and hence increasing the cost of production.

As it depends on the variation of the number of works and the number of kinds of the works, availability of each plating line differs from one another. As a result, there would be an excess of processing tanks in a low-availability plating line, while there would be a shortage of processing tanks in a high-availability plating line. Yet if they increase the number of hangers or carriages was increased to solve such problem, a large scale of addition and reconstruction of facilities would have been inevitable and quick measures could not have been taken to cope with the added facilities.

Further, there are some plated works which require to be re-plated with the same or different kind of plate and sometimes it is necessary to provide another series of processing tanks for the re-plating. On such occasion, the works would not be plated in a single substantially continuous series of processing steps and they are transported between the first series of processing tanks to the second series of processing tanks for the re-plating manually.

In the above-mentioned plating, the plated works would be deteriorated, e.g. discolored, when they are left in wet for a long time; in order to cope with this problem, a drying step is added. Grease and dust would stick to the accumulated works due to the atmosphere in the factory, or a natural oxidized film would occur on the metal surface; in order to cope with this problem, facilities for performing electrolytic degreasing, washing, weak-acidic saturation, etc. are added. Therefore, although these added facilities are common facilities among the individual processing lines, under the influence of the availability of each processing line they belong to, they are not used efficiently. Accordingly, the cost of production and the space occupied by the facilities are increased, thus lowering the productivity. If the first and the second plating steps can be performed continuously, the drying step and the pre-processing step would be unnecessary.

Further, the same problems as those described above also exist in the process of surface-treatment, such as alumite-treatment and a predetermined process to be performed by immersing the works in some liquid.

SUMMARY OF THE INVENTION

With the foregoing prior art problems in view, it is an object of this invention to provide a method and an apparatus for performing many kinds of immersion-processes efficiently with a simple construction.

According to a first aspect of the invention, there is provided a method for immersion-processing a plurality of kinds of works, comprising: providing a number of processing tanks 12 in which the works 10 are to be immersed for immersion-process, such as plating or surface-treating, and means, such as an unattended route-free vehicle 14, for transporting the works 10 to the processing tanks 12; calculating a processing time of each of the processing tanks 12 and a transporting time needed for the transporting means 14 to transport the works 10 to the processing tanks 12; and transporting one kind of the works 10 to one of the processing tanks 12 by the transporting means 14, during the immersion-processing of another kind of the works 10, to perform the immersion-process of the plurality of kinds of works 10 one after another. The unattended route-free vehicle 14 transports another kind of the works 10 to another processing tank 12 when one kind of the works 10 is immersed in the processing tanks 12 for more than a predetermined time.

According to a second aspect of the invention, there is provided an apparatus for immersion-processing a plurality of kinds of works, comprising: a number of processing tanks 12 in which the works 10 are to be immersed for immersion-process; means 14, such as an unattended route-free vehicle, for transporting the works 10 to the processing tanks 12; and a controller 20 being of a computer for calculating a processing time of the processing tanks 12 and a transporting time needed for the transporting means 14 to transport the works 10 to the processing tanks 12 and for rendering the transporting means to move to an arbitrary one of the processing tanks 12.

According to a third aspect of the invention, there is provided an apparatus for immersion-processing a plurality of kinds of works, comprising: a plurality of processing tanks 12 in which the plurality of kinds of works 10 are to be immersed for immersion-process, the processing tanks 12 being composed of a shared pre-processing block 30 in which a number of common processing tanks 12 to be commonly used for pre-processing the plurality of kinds of works 10 is disposed, a dedicated processing block 34 in which a number of dedicated processing tanks 12 each dedicated to a different immersion-process for each kind of the works 10 is disposed, and a shared post-processing block 37 in which a number of common processing tanks 12 to be commonly used for post-processing of the plurality of kinds of works 10 is disposed; means, such as an unattended route-free vehicle 14, for transporting the works 10 to each processing tank 12; and a controller 20 for calculating a processing time of each processing tank 12 and a transporting time needed for the transporting means 14 to transport the works 10 to each processing tank 12 and for rendering the transporting means 14 to an arbitrary one of the processing tanks 12. Each of the blocks includes a buffer tank 40 for which an immersing time of the works 10 can be set to an arbitrary value and which is disposed at a trailing end of each block.

The unattended route-free vehicle 14 is wirelessly connected to the computer 20, which is in turn connected to a network in the factory. The processing tanks 12 are to be commonly used for immersion-processing of the plurality of kinds of works 10.

DETAILED DESCRIPTION OF THE PREFERRED EMBODIMENTS

Figure 1:
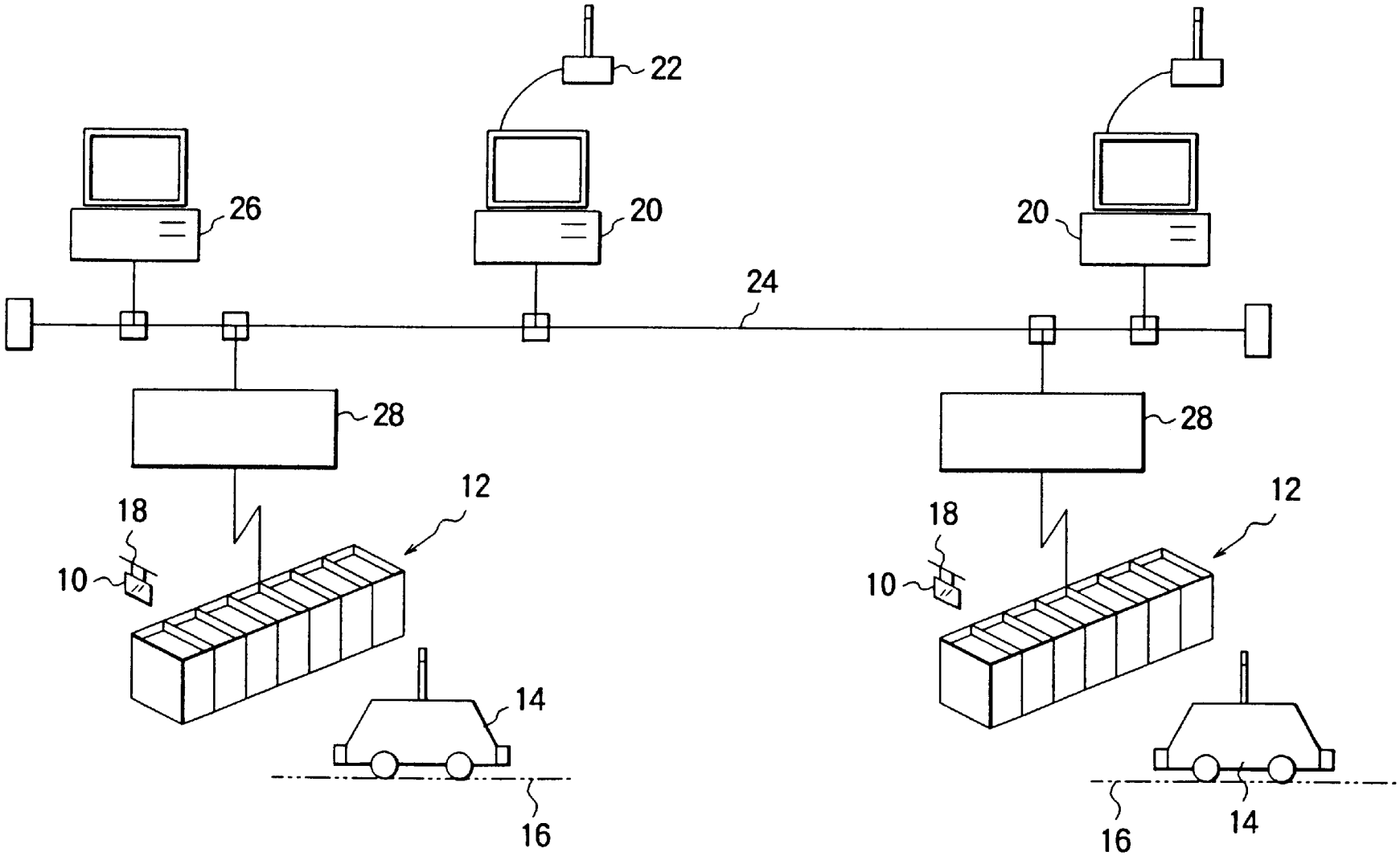
FIG. 1 is a diagram showing an immersion-processing apparatus according to a typical embodiment of this invention.

A typical embodiment of this invention will now be described in detail with reference to the accompanying drawings. An immersion-processing apparatus of the embodiment is a plating apparatus comprising, as shown in FIG. 1, a plurality of processing tanks 12 for plating a plurality of kinds of works 10, and an unattended route-free vehicle 14 movable along a traveling line 16. The processing tanks 12 are filled individually with a predetermined pre-processing liquid, a plating liquid and washing water. The works 10 to be plated are suspended by a predetermined hanger 18 and are immersed in the processing tanks 12.

The unattended route-free vehicle 14 is movable to a predetermined position along the traveling line 16 as electromagnetically, optically or magnetically guided. The movement of the route-free vehicle 14 is controlled by a controller 20; as a control signal from the controller 20 is received by a receiver of the route-free vehicle 14 via a radio unit 22, the route-free vehicle 14 moves to a predetermined position. The unattended route-free vehicle 14 has a non-illustrated arm such as a manipulator to hold and move the hanger 18.

The controller 20 being a computer is connected to an in-company LAN network 24 and to a production-management-dedicated computer 26, etc. Further, a plurality of sequencers 28 connected respectively to each of the processing tanks 12 is connected to the network 24.

Figure 2:
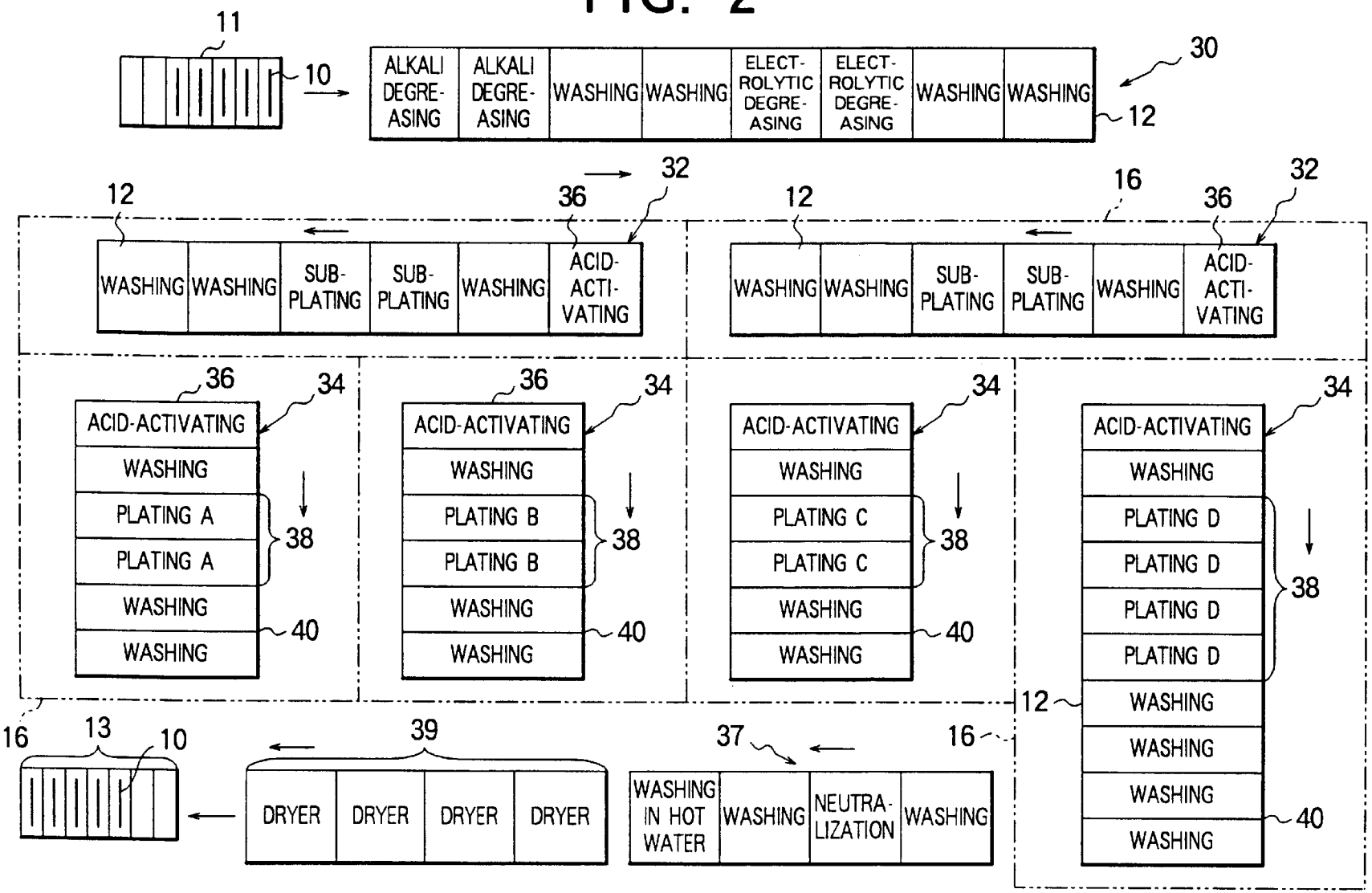
FIG. 2 is a diagram showing the arrangement of processing tanks according to a typical embodiment of this invention.

The processing tanks 12, as shown in FIG. 2, includes a degreasing line 30, which has a stockyard 11 and is a shared pre-processing step to be commonly used for various plating processes, a sub-plating line 32 for performing various kinds of sub-plating processes, a number of dedicated plating lines 34 for performing various predetermined plating processes after the sub-plating processes. In the stockyard 11, a plurality of works 10 waiting for plating processes are arranged in order. The degreasing line 30 and the sub-plating line 32 are commonly used for various plating and are disposed as a common pre-processing block. Each of the dedicated plating lines 34 are respectively dedicated to a single kind of plating and are disposed as a dedicated processing block altogether. Further, a common post-processing line 37 for performing finishing processes, such as washing and neutralizing, which are common to various plating and a number of dryers 39 are disposed as a common post-processing block. Downstream of the common post-processing block, another stockyard 13 exists in which the plated and finished works 10 are to be arranged in order. Each of the lines 30, 32, 34, 37 as defined in blocks are formed of the processing tanks 12 in a suitable combination and along the lines of processing tanks 12, a traveling line 16 of the unattended route-free vehicle 14 extends.

Before plating, the surface of the work 10 to be plated is polished as a pre-process to eliminate any rough surface. Then the plating is started. In the pre-process in the pre-processing block, the work 10 is immersed in alkaline liquid and washed in water and is then immersed in alkaline liquid in which a current flows so that possible grease and dust are removed off the work surface. Then the work 10 is washed to clear alkaline liquid drops off its surface. In the sub-plating line 32, the alkali liquid on the work surface is neutralized, and an oxidized film is removed off the work surface by acid-activation process, whereupon the work 10 is washed in water.

Then the work 10 is firstly plated with copper as a sub-plate. This sub-plate serves to improve the adhesion of a dedicated nickel plate (or zinc plate or brass plate) to the surface of the work 10. The resulting work 10 is washed in water to clear the copper-plating liquid drops off its surface.

Subsequently, in the dedicated plating line 34, the work 10 is plated with nickel and then washed. After that, the work 10 is treated with the post-process and dried to complete a succession of steps of plating process. As demand arises, an additional metal plate such as for black-nickel, tin-nickel-alloy or gold, may be plated over the resulting work 10. In this case, the dedicated plating line 34 dedicated for the demanded kind of plating may be additionally provided.

The operation of the above-mentioned apparatus will now be described. As shown in FIG. 1, in the apparatus for plating process of the embodiment, the hanger 18 suspending the work 10 is transported to a predetermined processing tank 12 by the unattended route-free vehicle 14 under the control of the controller 20.

The processing tanks 12 includes short-time intermediate tanks 36, such as acid-activating tanks, from which the works 10 have to be moved to the next step after the lapse of a relatively short predetermined period; long-time intermediate tanks 38, such as various plating tanks, whose processing time is so long that another hanger 18 can be moved during the process; and buffer tanks 40, such as washing tanks, from which the hangers 18 are not necessarily removed after the lapse of a predetermined period.

One or more processing tanks 12 from the processing tank 12 next to one buffer tank 40 to the next buffer tank 40 is treated as a single processing block. From the processing tank 12 next to one buffer tank 40 to one long-time intermediate tank 38, or from one long-time intermediate tank 38 to the next long-time intermediate tank 38, or from one long-time intermediate tank 38 to one buffer tank 40 is treated as a single moving block. Accordingly, a succession of plating process is treated as a group of processing blocks. Therefore, after confirming the security of the work 10 in a single processing block, a control program can transmits the data of the process in a single moving block to the unattended route-free vehicle 14, thus flexibly coping with any processing step.

Plating conditions (such as the processing order of the processing tanks 12 and a processing time of each processing tank 12) of the works 10 are set individually for each lot of products by the production management computer 26 and are transmitted to the individual controllers 20 to be managed there. On receiving a current position of the route-free vehicle 14 from the vehicle 14, and a processing status of the work 10 and a lapsed time of processing of the work 10, which is immersed in the individual processing tank 12, from the sequencer 28, the controller 20 creates a processing route of the next step for the work 10 which is going to finish its process in the processing tank 12 it currently being immersed as well as a control data for the unattended route-free vehicle 14 and transmits the data to the vehicle 14. According to the received control data, the route-free vehicle 14 moves and transports the hanger 18. The control program of the controller 20 is programmed so as to prevent any crash between the individual works 10 in the processing tanks 12, to secure the safe transportation of the works, which is being processed in the long-time intermediate tank 38, to the next step after the lapse of a designated processing period, and to prevents any crash between the route-free vehicles 14.

Figure 3:
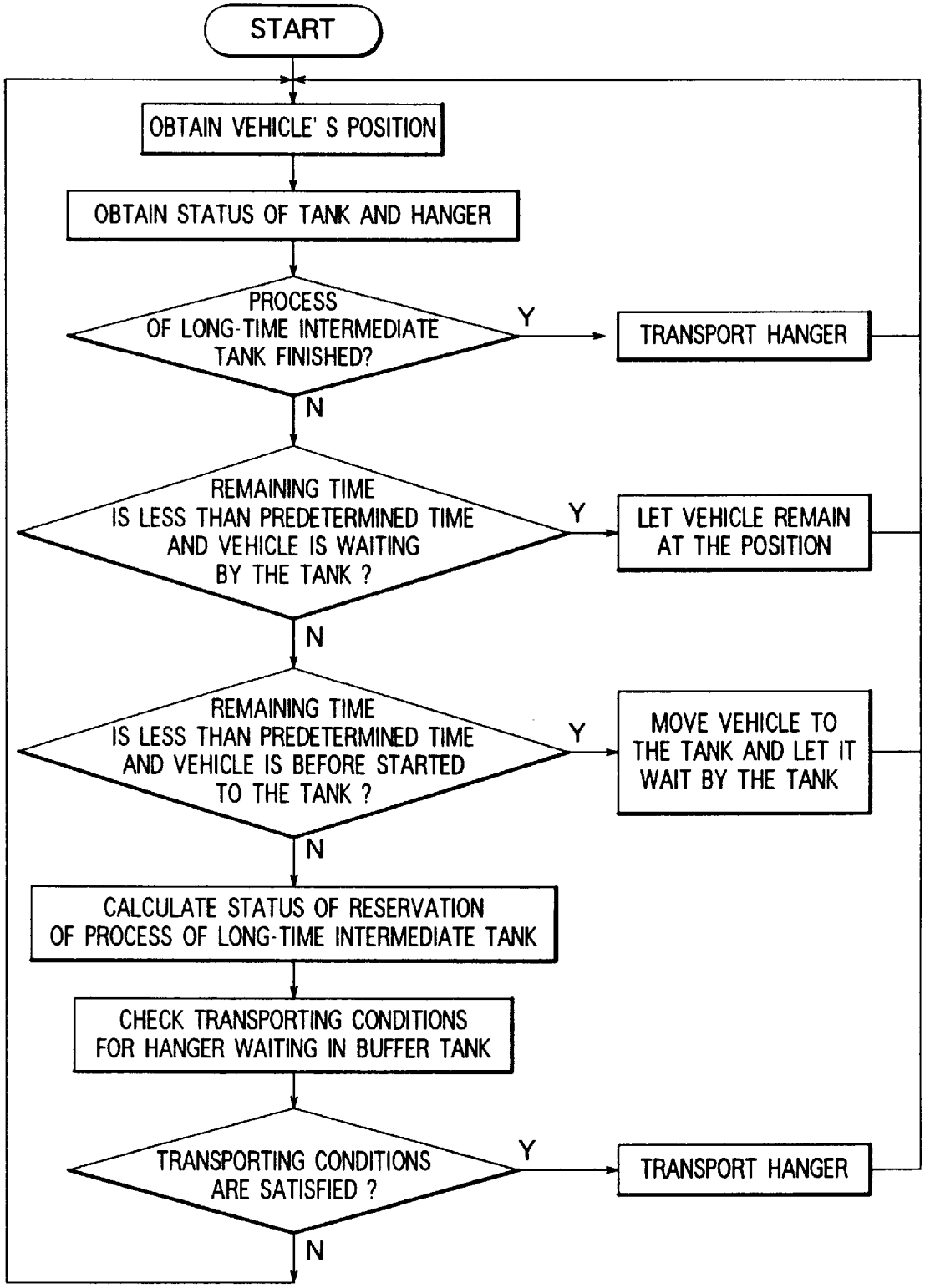
FIG. 3 is a flowchart showing an immersion-processing method according to a typical embodiment of this invention.

The controller 20 control the route-free vehicle 14 and the hanger 18 as follows. Firstly, as shown in FIG. 3, first the current position of the route-free vehicle 14 is confirmed by the radio unit upon termination of the transportation of a particular work 10. Then, in regard to the every processing tank 12, the controller 20 obtains information whether the work 10 is immersed in it or not, lot number of the works 10, and a lapsed time to process the individual work 10 from the sequencers 28 and calculates a remaining time of processing of the individual work 10.

Then regarding the processing tank 12 in which the hanger 18 exists, the controller 20 calculates a remaining time to process the work 10 immersed in the processing tank 12, to check whether or not the processing of the work 10.

If the processing of the work 10 is completed, the hanger 18 suspending the work 10 is transported to the next step. The hanger 18 is moved to the designated processing tank 12 as it is lifted by the non illustrated arm of the vehicle 14, and then immersed in the designated processing tank 12 as it is brought down by the arm. Whereupon, in regard to the processing tank 12 in which the work 10 exists, the controller 20 calculates the remaining time to process the work 10.

Assuming that the processing of the work 10 in the long-time intermediate tanks 38 has not yet been completed, if the remaining time to process the work 10 is less than a predetermined time, e.g. a period for the route-free vehicle 14 to transport the work and to return, and if the route-free vehicle 14 stays waiting by the processing tank 12, the vehicle 14 waits there till the next process. Assuming that the route-free vehicle is not waiting by the processing tank 12, if the remaining time to process the work 10 in the processing tank 12 is less than a predetermined time and if the route-free vehicle 14 is not moved toward the position of the processing tank 12 yet, the route-free vehicle 14 is moved.

If the route-free vehicle 14 has already been moved toward the processing tank 12, the controller 20 calculates a transporting time needed for the route-free vehicle 14 to transport the work 10 from the long-time intermediate tank 38 to the next step after the process of the work 10 in the long-time intermediate tank 38 is terminated. If the next step is the re-plating process in the long-time intermediate tank 38, the controller 20 calculates a processing time in the long-time intermediate tank 38 and a transporting time needed for the route-free vehicle 14 to transport the work 10 to the next step after this processing. Then the controller 20 reserves a time to use the route-free vehicle 14 after termination of the current process.

For transporting the hanger 18 waiting in the buffer tank 40, the controller 20 checks whether or not the following transporting conditions are satisfied, and if satisfied, moves the hanger 18 to the next processing tank: first of all, the destination-side processing tank is open; in the processing tanks between the individual buffer tanks, there do not exist between the leading processing tank and the buffer tank a number of works more than the number of the buffer tanks and preliminary buffer tanks; while the work in the buffer tank is transported to the next step, the processing time of the work in process in another long-time processing tank will not terminate; and if the long-time intermediate tank 38 exists at the destination side, the transporting time needed for the route-free vehicle 14 to transport the work after termination of the processing time of the processing tank does not coincide with the transportation of the work from another long-time intermediate tank to the buffer tank. Further, in transporting the works 10, priorities are assigned to the works of the long-time intermediate tank 38; in the absence of any processed work 10 in the long-time intermediate tank 38, priorities are assigned to the works near the terminal end of the processing step.

According to the plating apparatus of this embodiment, since upon completion of process of the work 10, the controller 20 obtain a route along which the work 10 is to be transported by the route-free vehicle 14, it is possible to decide the order of processing of the works 10 and the order of moving of the route-free vehicles 14 and to process many kinds of works 10 concurrently so that the order of introduction of the works 10 to the processing tank 12 also can be changed freely, thus considerably increasing the processing efficiency.

Further, since the pre-processing tanks 30 and the post-processing tanks are shared tanks 37, it is possible to perform various plating processes with improved efficiency. And the long-time intermediate tanks 38 for performing predetermined plating processes can be arranged in a relatively free fashion. It is also possible to reduce the whole size of the apparatus to a minimum and to flexibly cope with any change of the plating process. Furthermore, it is possible to secure a reliable processing-step control free from jamming of works in the processing lines and to prevent oxidation of the surfaces of the works and sticking of dust to the plated work surfaces.

Furthermore, as shown in FIG. 3, according to the plating apparatus of this embodiment, it is possible to modify the number of the processing tanks 12 according to the availability of each dedicated plating lines 34 easily. When the number of the processing tanks 12 is changed, the setting of the controller 20 for the number of the processing tanks 12 in each dedicated plating lines 34 is also changed. Whereupon, the traveling line 16 of the rout-free vehicle 14 is partly modified. Because of this modification, the distance of the traveling line 16 is changed and the controller 20 newly calculates the running time of the rout-free vehicle 14. Then, the controller 20 transmit the command, which is based on the result of the calculation, to the rout-free vehicle 14 to transport the hanger 18 according to the steps described in the above.

Although, the buffer tanks 40, from which the hangers 18 are not necessarily removed after the lapse of a predetermined period, are arranged at the end of the dedicated plating lines 34 in this embodiment, they may be arranged in a different line, i.e., the line composed of a plurality of the buffer tanks 40.

The method and apparatus of this invention should by no means be limited to the illustrated embodiments and may be applied to other immersion-processing, such as processing of metal products (e.g., alumite-processing), and surface-treating, coating and dyeing of resin products, as well as other surface-treating.

According to the immersion-processing apparatus and method, since many kinds of processing tanks are combined, it is possible to efficiently perform various immersion-processes concurrently in parallel, to reduce the whole size of the apparatus as compared to the conventional art, in which a plurality of processing lines are arranged independently of one another, and to flexibly cope with any change of processing steps. Further, by using a single processing tank 12 commonly for a plurality of kinds of works 10, it is possible to improve the availability of the processing tanks 12 and to perform immersion-processing efficiently in a reduced area occupied by the apparatus.

What is claimed is:

1. An apparatus for plate treating a plurality of kinds of metal works by immersion-processing, comprising:

(a) a plurality of processing tanks in which a plurality of kinds of metal works are to be immersed for immersion-processing, said processing tanks being sectionalized into at least three separate blocks including a shared pre-processing block, a dedicated processing block and a shared post-processing block, the shared pre-processing block having a number of common pre-processing tanks, said shared pre-processing block being for surface treatment of said plurality of kinds of works prior to plate treatment, the dedicated processing block being composed of a plurality of dedicated processing lines for plating and having a number of dedicated plate processing tanks each of which is dedicated to a different immersion-plate-process for each kind of works, and the shared post-processing block having a number of common post-processing tanks, said post-processing block being used for post-processing said plurality of kinds of works which have been given a dedicated plate treatment;

(b) a plurality of vehicles guided by control signals for transporting individual works between the pre-processing, dedicated processing and post-processing blocks, the vehicle also for immersing the works to each processing tank; and (c) a controller for calculating a processing time of each processing tank and a transporting time needed for said vehicles to transport each of said works to each processing tank and for controlling by providing said control signals to said vehicles so as to move each of said plurality of kinds of works to said shared pre-processing block, to a selected one of said dedicated plate processing lines of said dedicated plate processing block, and to said shared post-processing block successively, according to the kind of said work.

2. An apparatus according to claim 1, wherein said tanks of each of said blocks includes one or more buffer tanks for which an immersing time of said works can be set to an arbitrary value, and at least one of said buffer tanks is disposed at an end of each of said lines of said block.

3. An apparatus according to claim 2, wherein said tanks of each of said blocks comprise one or more intermediate tanks for which an immersing time of said works can be set to an arbitrary value, and the number of said buffer tanks is equal to the number of said one or more intermediate tanks in each of said blocks.

4. An apparatus according to claim 1, at least one of said blocks further comprising a buffer tank line which is exclusively composed of a plurality of buffer tanks.

5. A computer controlled apparatus for sequentially and/or simultaneously plate treating a plurality of metal workpieces by immersion processing, said apparatus comprising:

a plurality of separate linear arrays of immersion processing tanks including a first array providing shared pre-processing, a plurality of second arrays each providing an intermediate dedicated plating processing, and a third array providing a shared post-processing, each said linear array having an upstream end and a downstream end and including at least one buffer tank disposed at the downstream end;

a plurality of control signal guided vehicles each having a manipulatable arm for moving a metal workpiece from one immersion processing tank to another and from one separate linear array to another separate linear array in response to command control signals received by the guided vehicle; and a computer controller for providing control signals to the plurality of vehicles for coordinating movement of metal workpieces from the upstream end to the downstream end of the first array, from the downstream end of the first array to an upstream end of at least one said second array, from the upstream end to the downstream end of said at least one said second array, from the downstream end of said at least one said second array to an upstream end of said third array, and from the upstream end to the downstream end of the third array to provide immersion plate processing for each metal workpiece.

6. An apparatus as defined in claim 5, further comprising a plurality of hangers on which at least one metal workpiece to be immersion-processed may be releasably mounted, and the manipulatable arm of the guided vehicle moves each hanger from one immersion-processing tank to another and from one linear array to another linear array.

* * * * *